United States Patent [19]

Gili

[11] 3,940,015

[45] Feb. 24, 1976

[54] REFILL DEVICE FOR GAS LIGHTERS

[75] Inventor: Ricardo Aguirre Gili, Barcelona, Spain

[73] Assignee: Flamagas S.A., Barcelona, Spain

[22] Filed: Jan. 9, 1974

[21] Appl. No.: 431,984

[52] U.S. Cl. ..... 221/96; 222/192

[51] Int. Cl.[2] ..... B67D 5/37

[58] Field of Search ..... 222/183, 402.1, 402.17, 222/402.21, 402.22, 402.23, 182, 192, 130, 131; 221/86, 199, 96; 206/42, 229, 216; 220/23

[56] References Cited

UNITED STATES PATENTS

| | | | |
|---|---|---|---|
| 3,224,645 | 12/1965 | Frost | 222/182 X |
| 3,421,651 | 1/1969 | Henderson et al. | 222/182 X |
| 3,438,537 | 4/1969 | Hendrickson et al. | 222/182 X |
| 3,446,339 | 5/1969 | Thompson | 206/42 |
| 3,557,747 | 1/1971 | Rigney et al. | 221/86 X |
| 3,653,416 | 4/1972 | Hocq | 222/182 X |
| 3,765,573 | 10/1973 | Landsman | 222/182 |

FOREIGN PATENTS OR APPLICATIONS

| | | | |
|---|---|---|---|
| 1,154,775 | 6/1969 | United Kingdom | 222/192 |
| 1,090,949 | 11/1967 | United Kingdom | 222/182 |

*Primary Examiner*—Robert B. Reeves
*Assistant Examiner*—Charles A. Marmor
*Attorney, Agent, or Firm*—Ostrolenk, Faber, Gerb & Soffen

[57] ABSTRACT

A refill device for a gas operated lighter, which refill device includes a gas container with an outlet valve; a separable cover fitted on the container over the valve; various separate compartments in the cover and each compartment containing a respective outlet valve adapter for different size and style inlet valves on different lighters; the adapter containing cover having a cap thereover rotatable with respect thereto and having an access aperture therethrough for access to each adapter in turn.

2 Claims, 6 Drawing Figures

REFILL DEVICE FOR GAS LIGHTERS

This invention relates to refill devices for gas lighters.

Refill devices are already known which permit a given gas lighter to be refilled a predetermined number of times. A prerequisite of such devices is, however, that they should have an outlet valve compatible in shape and size with the inlet valve of the associated lighter. As a result, lighter manufacturers have to specify the refill devices suitable for their lighters, and the retail is unnecessarily complicated owing to the presence of a number of refill devices each specifically designed for certain types of lighter only.

It is an aim of this invention to provide a "universal" multi-refill device, i.e. a device capable of being used to refill different lighters, notwithstanding variations in the dimensions of their gas inlet valves.

According to the present invention, there is provided a refill device for use with different gas lighters irrespective of the dimensions of the gas inlet valves thereof, the device including a gas container provided with a gas outlet valve, and a cover fittable on the container and carrying a plurality of differently sized valve adaptors, each said adaptor being connectable to the outlet valve and a said inlet valve of given dimensions so as to establish leakfree flow communication therebetween.

The cover and the container are preferably detachably secured together by complementary fastening elements on the cover and the container, respectively, which elements are interengaged as a result of pressing the cover and the container towards each other.

Preferably, a cap is provided to overlie the cover.

The cover may be provided with fastening elements in the form of a plurality of arcuate depending legs respectively snap-fittable with respect to a complementary fastening element surrounding the outlet valve, said complementary element being a collar.

The periphery of the cover is preferably adapted to rest on the container which has a domed portion carrying the outlet valve.

Advantageously, the cap may be snap-fittable with respect to the cover.

In a preferred embodiment, the cap has a central portion with a plurality of depending flaps resiliently engageable with transverse flanges on said legs.

The cover may be provided with a plurality of compartments for readily removably housing individual adaptors.

Preferably, the cap is rotatable with respect to the cover and is provided with a through-going aperture so as to permit a selected adaptor to be uncovered and removed.

The invention will now be described by way of example only, with reference to the preferred embodiment shown in the accompanying drawings, wherein.

Figure 1:
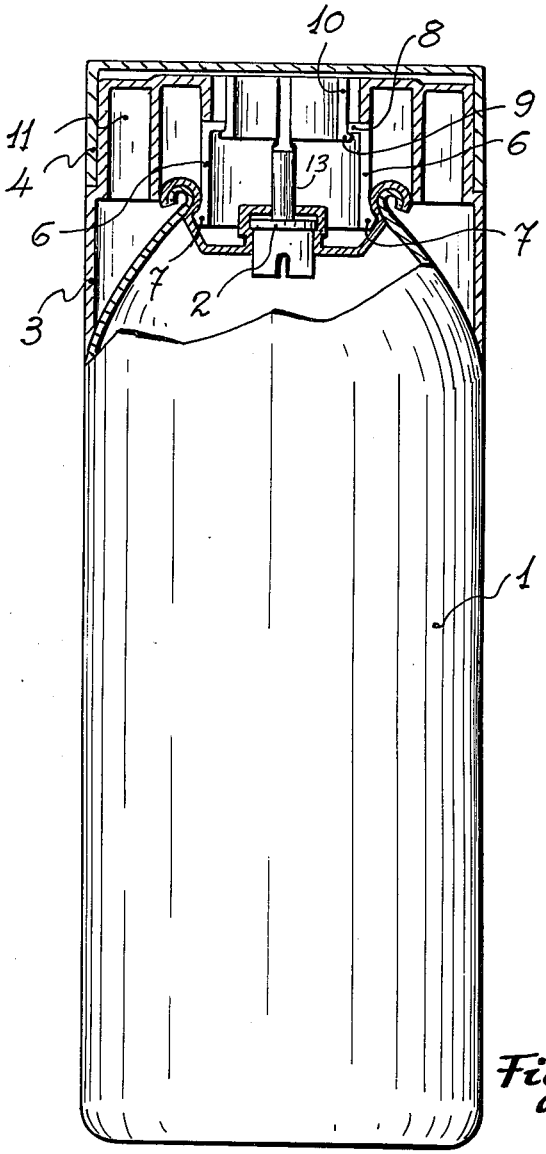
FIG. 1 is a partially broken away perspective view of a refill device according to this invention.
Figure 3:
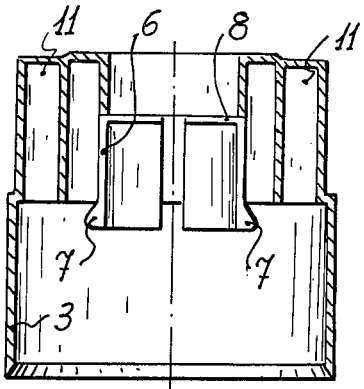
FIGS. 2 and 3 show, on an enlarged scale, respectively, in bottom plan view and in transverse section, a cover forming part of the refill device shown in FIG. 1, and FIGS. 4 and 5 show, also on an enlarged scale, respectively, in bottom plan view and in transverse section, a cap forming part of the refill device shown in FIG. 1.
Figure 2:
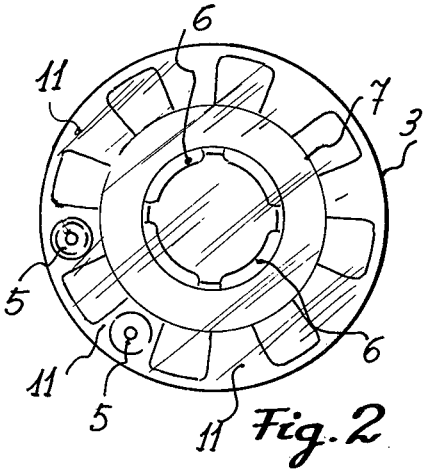
Figure 4:
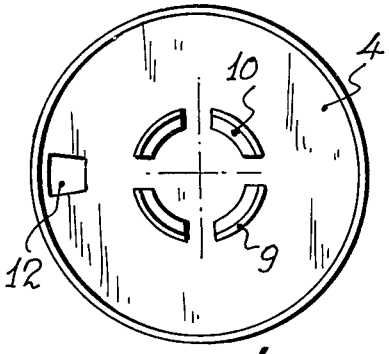
Figure 5:
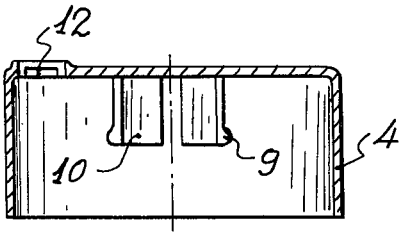
Figure 6:
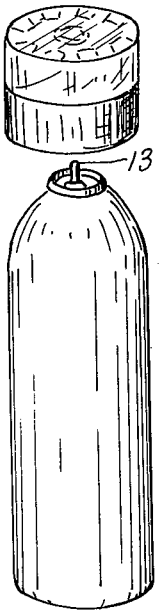
FIG. 6 is a partially exploded perspective view of a refill device as shown in FIG. 1.

The multi-refill device includes a one-piece, hollow, cylindrical gas container 1 having a domed upper end (as viewed) terminating in a central gas outlet valve 2. The valve 2 has a central tube 13 and is surrounded by an annular collar.

An annular cover 3 of substantially inverted U-section is fittable over the domed end of the container. The cover 3 has a central portion formed with a number of, in this example, four depending, arcuate, resilient legs 6 terminating in respective beads 7 for snap-fitting engagement with the collar, the collar and the legs thus providing complementary fastening elements detachably securing the cover to the container. The legs 6 have respective radically inwardly directed flanges 8. In addition, the base of the inverted U-shaped cover 3 is provided with a plurality of angularly spaced apart depending walls connected in pairs so as to form equi-spaced compartments 11. Each compartment 11 houses an adaptor or nozzle 5 in a readily removable manner. One end of each adaptor 5 is a good fit on the tube 13.

An annular cap 4 is snap-fittable over the cover 3. The periphery of the cap 4 can rest on an inwardly directed annular shoulder on the cover 3, while its central portion has depending flaps 10. In this example, there are four arcuate, resilient flaps 10 each terminating in respective beads 9 adapted to snap over the flanges 8. The top surface (as viewed) of the cap 4 is formed with a peripheral, throughgoing aperture or window 12. The cap 4 is rotatable relative to the cover 3 to permit the window 12 to be brought into registry with any desired one of the adaptors 5.

The operation of the device is as follows. The cover 3 is provided with as many adaptors 5 as there are different lighter inlet valves on the market. Then, to refill any particular lighter, the appropriate adaptor 5 is selected, by trial-and-error or by markings on the cover 3. The cap 4 is then rotated so as to align the window 12 with the selected adaptor 5 to enable removal of the latter while retaining the non-selected adaptors 5 in their compartments 11.

The cover 3 and the cap 4 are then removed together, the selected adaptor 5 fitted onto the tube 13 of the valve 2, and the device is then ready for connection to the inlet valve of the lighter it is desired to refill.

What we claim is:

1. A refill device for gas operated lighters comprising:

a gas container having an end; a gas outlet valve at said end of said container; a collar around said container near its said one end and spaced from said outlet valve;

a separate cover having an axis and fitted on said container over said end; said cover having a top side away from said container; said cover including a plurality of compartments, which are arrayed around said cover axis in positions that enable access into the tops of said compartments through said cover top side and through an aperture in a covering cap; each said compartment being for containing a different outlet valve adapter;

a plurality of outlet valve adapters; in each of at least some of said compartments is a respective said adapter; each said adapter being connectable to said outlet valve of said refill device and also to the inlet valve of a particular lighter;

said cover and said container being provided with respective complementary fastening elements, which said fastening elements are interengaged by pressing said cover and said container together;

said cover fastening elements comprise a plurality of resilient legs, arcuately curved around and arrayed around said cover axis; said legs being secured to and depending from said cover and extending toward said collar; said container fastening elements comprise said collar; said cover legs having lower end portions that are shaped to be snap fit onto said collar as said legs are deformed and resiliently snap return to shape upon motion toward one another of said container and said cover;

said cover legs having upper end portions; cover leg transverse flanges extending transversely of said cover axis and located at said cover leg upper end portions;

said cover top side having an opening therethrough at said cover legs for cap flaps to pass therethrough;

a separate cap overlying said cover; said cap having a central region from which depend a plurality of resilient depending flaps that extend through said cover opening and that are shaped to engage and be snap fit onto said cover leg transverse flanges as said flaps are deformed and resiliently snap return to shape upon motion toward one another of said cover and said cap; the connection of said cap flaps and said cover leg transverse flanges being such that said cap can be rotated with respect to said cover around said cover axis;

said cap being provided with a through aperture that is positioned in said cap so as to be alignable with said top of each said compartment in turn; said cap aperture being of a size sufficient to permit each said adapter to be drawn therethrough; said compartments being located around said cover axis such that rotation of said cap uncovers each said compartment in turn; said compartments being open topped at their said tops at said cover top side to communicate through said cap aperture with the exterior of said refill device.

2. A refill device as claimed in claim 1, wherein said transverse flanges of said cover legs extend radially inwardly of said cover toward its said axis; said cap flaps being arcuately arrayed on a lesser diameter than and coaxial with said cover legs and said cap flaps extending down past said cover leg transverse flanges; said cap flaps including a first outwardly projecting bead, which engages said transverse flanges for snap securing said cap flaps beneath said transverse flanges as said flaps are deformed and resiliently snap return to shape upon moving of said cover and said cap together;

said cover leg lower end portions being shaped to define a second outwardly projecting bead; said container collar being positioned about said cover axis such that said collar presses said second bead and said cover legs inwardly as said cover and said container are pressed together, and when said second bead passes said collar, said cover legs snap fit against said collar.

* * * * *